United States Patent [19]

Cappel

[11] 4,394,440

[45] Jul. 19, 1983

[54] YELLOW-DYE-FORMING PHOTOGRAPHIC DEVELOPING COMPOSITION

[75] Inventor: Carl R. Cappel, Rochester, N.Y.

[73] Assignee: Eastman Kodak Company, Rochester, N.Y.

[21] Appl. No.: 341,712

[22] Filed: Jan. 22, 1982

[51] Int. Cl.[3] ..... G03C 7/16; G03C 7/00

[52] U.S. Cl. ..... 430/379; 430/468; 430/471; 430/472; 430/475

[58] Field of Search ..... 430/363, 468, 471, 472, 430/475, 379

[56] References Cited

U.S. PATENT DOCUMENTS 3,658,525 4/1972 Bent et al. ..... 96/22
3,816,134 6/1974 Schellenberg et al. ..... 96/55
3,929,484 12/1975 Ross ..... 96/55
4,155,763 5/1979 Hasebe ..... 430/363

FOREIGN PATENT DOCUMENTS 731087 3/1966 Canada .

*Primary Examiner*—J. Travis Brown
*Attorney, Agent, or Firm*—A. P. Lorenzo

[57] ABSTRACT

A yellow-dye-forming photographic developing composition having improved stability comprises a haloacetanilide coupler, such as alpha-pivalyl-alpha-(4-carboxyphenoxy)-2,4-dichloroacetanilide, an N-alkyl-N-alkoxyalkyl-p-phenylenediamine developing agent, such as 4-amino-N-ethyl-N-(2-methoxyethyl)-m-toluidine di-p-toluene sulfonate, and a 4,4-disubstituted-1-aryl-3-pyrazolidinone, such as 4,4-dimethyl-1-phenyl-3-pyrazolidinone.

7 Claims, No Drawings

YELLOW-DYE-FORMING PHOTOGRAPHIC DEVELOPING COMPOSITION

FIELD OF THE INVENTION

This invention relates in general to color photography and in particular to processes and compositions for the development of photographic images. More specifically, this invention relates to an improved yellow-dye-forming photographic developing composition of the type containing a primary aromatic amino color developing agent and a diffusible coupler.

BACKGROUND OF THE INVENTION

In multilayer photographic elements used for color photography there are usually three selectively-sensitized emulsion layers coated on one side of a photographic support. For example, the uppermost layer is generally blue sensitive, the next layer generally comprises a yellow filter and the next layer is generally green sensitive. The emulsion layer adjacent to the support is generally red sensitive. The yellow filter layer located between the blue and green sensitive layers serves to absorb the blue radiation which may be transmitted through the blue-sensitive layer to the underlying layers which are sensitive to the blue region of the spectrum in addition to the red or green regions of the spectrum. Some of these multilayer photographic elements contain additional silver halide emulsion layers for specialized purposes. In photographic print material, frequently the yellow filter layer is omitted and the arrangement of silver halide emulsion layers may be changed for the purpose of obtaining more accurate recording of the color image.

Photographic elements of the type employed in the present invention are typically subjected to a reversal color process in which the exposed material is given a conventional black-and-white negative development, followed by a reversal re-exposure or exposures and finally color development. Usually, phenolic or naphtholic couplers are used to produce the cyan dye, open chain di-$\beta$-ketone couplers are generally used for producing yellow dye images and 2-pyrazolin-5-one couplers generally are used to produce the magenta dye images. In the development step, the dye image is produced by contacting the reversal exposed silver halide with an aqueous alkaline developer solution containing a primary aromatic amino color developing agent in the presence of the appropriate color-forming coupler.

In the processing of photographic color materials by a reversal technique in which the color-forming couplers are incorporated in the color developers, it is well known to use a balancing developing agent in one or more of the color developers. This practice is particularly common with respect to the cyan color developer, but may also be employed in the magenta color developer and the yellow color developer. Such balancing developing agents generally serve two functions; first, such balancing developing agents act as antioxidants and they frequently react with oxidized color developers through a cross-oxidation reaction which regenerates the desired color developing agents; secondly, such balancing developing agents react directly with the exposed silver halide as an auxiliary developing agent. The desired effect of using such balancing developing agents is to improve the photographic quality, for example, to decrease high light stain and/or improve the sensitometric curve shape for the developed dye image.

A particularly valuable class of diffusible couplers for use in yellow-dye-forming developing compositions are the haloacetanilide couplers described in Ross, U.S. Pat. No. 3,929,484, issued Dec. 30, 1975. These couplers are particularly advantageous in photographic processing in that they exhibit excellent solubility properties and excellent color-forming efficiency. Primary aromatic amino color developing agents which are especially advantageously utilized in yellow-dye-forming developing compositions containing the aforesaid haloacetanilide couplers are the N-alkyl-N-alkoxyalkyl-p-phenylenediamines of Bent et al, U.S. Pat. No. 3,658,525 issued Apr. 25, 1972.

To increase the rate of color development and the maximum density of the dye image, it is well known to incorporate a 3-pyrazolidinone balancing developing agent in a color developing composition containing a primary aromatic amino color developing agent and a diffusible coupler (see, for example, Canadian Pat. No. 731,087 issued Mar. 29, 1966). Heretofore, the compound 1-phenyl-3-pyrazolidinone has been used as a balancing developing agent in a yellow-dye-forming developing composition of the type described above; specifically a composition in which the haloacetanilide coupler is alpha-pivalyl-alpha-(4-carboxyphenoxy)-2,4-dichloroacetanilide and the N-alkyl-N-alkoxyalkyl-p-phenylenediamine developing agent is 4-amino-N-ethyl-N-(2-methoxyethyl)-m-toluidine di-p-toluene sulfonate. While such yellow-dye-forming developing composition has enjoyed extensive commercial use and generally exhibits excellent characteristics, an improvement in its stability would be highly advantageous to minimize loss in yellow D-max.

It is toward the objective of providing an improved yellow-dye-forming developing composition of significantly increased stability that the present invention is directed.

SUMMARY OF THE INVENTION

In accordance with this invention, a yellow-dye-forming developing composition having improved stability comprises:

(1) a haloacetanilide coupler of the formula

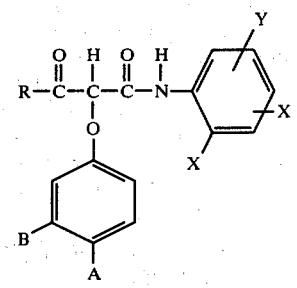

wherein R is a branched alkyl group of 3 to 6 carbon atoms, X is Cl or Br, Y is X, hydrogen or alkyl of 1 to 8 carbon atoms, and A and B differ and are either H or COOM where M is a photographically inactive cation or a methyl or ethyl group;

(2) an N-alkyl-N-alkoxyalkyl-p-phenylenediamine developing agent of the formula

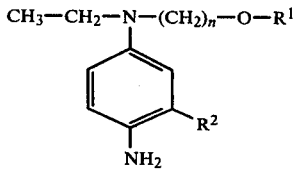

wherein n is an integer having a value of from 2 to 4, $R^1$ is alkyl of from 1 to 4 carbon atoms, and $R^2$ is alkyl of from 1 to 4 carbon atoms or alkoxy of from 1 to 4 carbon atoms;

and (3) a 4,4-disubstituted-1-aryl-3-pyrazolidinone balancing developing agent of the formula

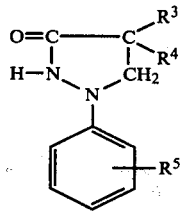

wherein $R^3$ and $R^4$ are the same or different and each is alkyl of 1 to 6 carbon atoms or hydroxyalkyl of 1 to 6 carbon atoms, and $R^5$ is hydrogen, halogen, alkyl of 1 to 6 carbon atoms, or alkoxy of 1 to 6 carbon atoms.

The improved stability of the yellow-dye-forming developing composition of the present invention in comparison with the prior art developing composition is a consequence of the use of the 4,4-disubstituted-1-aryl-3-pyrazolidinone in place of the 1-phenyl-3-pyrazolidinone. In particular, it has been unexpectedly found that the oxidation product of 1-phenyl-3-pyrazolidinone undergoes a chemical reaction with oxidized N-alkyl-N-alkoxyalkyl-p-phenylenediamines such as 4-amino-N-ethyl-N-(2-methoxyethyl)-m-toluidine di-p-toluene sulfonate to form an hydroxypyrazole compound. The hydroxypyrazole is able to function as a developing agent, and thus it competes with the p-phenylenediamine developing agent, resulting in reduced formation of image dye. The hydroxypyrazole also couples with haloacetanilide couplers such as alpha-pivalyl-alpha-(4-carboxyphenoxy)-2,4-dichloroacetanilide to again result in reduced formation of image dye. These unwanted reactions are a severe disadvantage of the prior art developing composition. In the developing composition of the present invention, the 4,4-disubstituted-1-aryl-3-pyrazolidinone provides similar benefits to the 1-phenyl-3-pyrazolidinone used in the prior art composition, but, because it is disubstituted in the 4-position, it does not react to form the hydroxypyrazole and, accordingly, the adverse consequences resulting from the formation of the hydroxypyrazole are eliminated.

DESCRIPTION OF THE PREFERRED EMBODIMENTS

The yellow-dye-forming developing compositions of this invention contain three essential ingredients as explained above. They can also contain any of the various additional components that are ordinarily incorporated in photographic color developing solutions, for example, materials such as alkali metal sulfites, alkali metal bisulfites, alkali metal thiocyanates, alkali metal bromides, chlorides or iodides, hydroxylamines, thickening agents, solubilizing agents, sequestering agents, brightening agents, wetting agents, stain reducing agents, and so forth. The pH of the working strength developing solution is above 7 and most typically about 10 to about 13.

The haloacetanilide coupler is employed in the working strength developing solution in an amount of from about 1 to about 8 grams per liter, more usually from about 1 to about 4 grams per liter, and preferably from about 2 to about 3 grams per liter.

Specific examples of the haloacetanilide couplers employed in this invention include:

alpha-pivalyl-alpha-(4-carboxyphenoxy)-2,4-dichloroacetanilide,
alpha-pivalyl-alpha-(5-carboxyphenoxy)-2,4-dichloroacetanilide,
alpha-pivalyl-alpha-(4-carboxyphenoxy)-2,4-dibromoacetanilide.
alpha-pivalyl-alpha-(4-carboxyphenoxy)-2-chloro-4-bromo-acetanilide,
alpha-pivalyl-alpha-(4-carboxyphenoxy)-2-chloro-4-methyl-acetanilide, and the like.

The N-alkyl-N-alkoxyalkyl-p-phenylenediamine developing agent is employed in the working strength developing solution in an amount of from about 1 to about 8 grams per liter, more usually from about 1 to about 4 grams per liter, and preferably from about 2 to about 3 grams per liter.

Specific examples of the N-alkyl-N-alkoxyalkyl-p-phenylenediamine developing agents include:

N-ethyl-N-methoxyethyl-3-methyl-p-phenylenediamine,
N-ethyl-N-methoxybutyl-3-methyl-p-phenylenediamine,
N-ethyl-N-ethoxyethyl-3-methyl-p-phenylenediamine,
N-ethyl-N-methoxyethyl-3-n-propyl-p-phenylenediamine,
N-ethyl-N-methoxyethyl-3-methoxy-p-phenylenediamine,
N-ethyl-N-butoxyethyl-3-methyl-p-phenylenediamine, and the like.

The N-alkyl-N-alkoxyalkyl-p-phenylenediamine developing agents are typically utilized in the developing composition in the form of an acid salt. As described in Schellenberg et al, U.S. Pat. No. 3,816,134 issued June 11, 1974, the preferred salts are the salts of p-toluene sulfonic acid.

The 4,4-disubstituted-1-aryl-3-pyrazolidinone balancing developing agent is employed in the working strength developing solution in an amount of from about 0.1 to about 2 grams per liter, more usually from about 0.2 to about 0.8 grams per liter, and preferably from about 0.3 to about 0.5 grams per liter.

Specific examples of the 4,4-disubstituted 1-aryl-3-pyrazolidinone balancing developing agents include:

4,4-dimethyl-1-phenyl-3-pyrazolidinone,
4-hydroxymethyl-4-methyl-1-phenyl-3-pyrazolidinone,
4,4-di(hydroxymethyl)-1-phenyl-3-pyrazolidinone,
4,4-diethyl-1-phenyl-3-pyrazolidinone,
4-methyl-4-ethyl-1-phenyl-3-pyrazolidinone, and the like.

An example of a particularly preferred yellow-dye-forming developing composition within the scope of this invention is a composition comprising, as the developing agent, the compound 4-amino-N-ethyl-N-(2-methoxyethyl)-m-toluidine di-p-toluene sulfonate which has the formula:

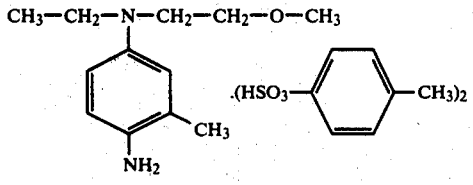

as a coupler, the compound alpha-pivalyl-alpha-(4-carboxyphenoxy)-2,4-dichloroacetanilide, which has the formula:

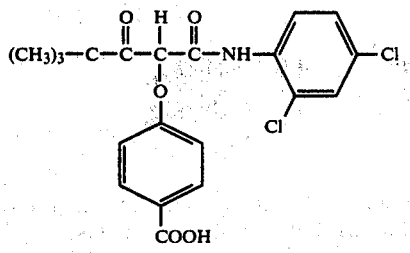

and, as a balancing developing agent, the compound 4,4-dimethyl-1-phenyl-3-pyrazolidinone, which has the formula:

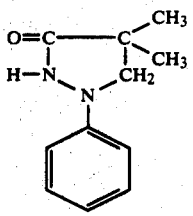

An important aspect of the use of color developing compositions containing diffusible couplers is the effectiveness of processes for recovery of the coupler. This is economically important because of the high costs involved in the use of such couplers. With the prior art yellow-dye-forming developing composition containing alpha-pivalyl-alpha-(4-carboxyphenoxy)-2,4-dichloroacetanilide, 4-amino-N-ethyl-N-2-methoxyethyl)-m-toluidine di-p-toluene sulfonate, and 1-phenyl-3-pyrazolidinone, recovery of the alpha-pivalyl-alpha-(4-carboxyphenoxy)-2,4-dichloroacetanilide can be readily accomplished by reducing the pH to a level of about 5.5 to cause precipitation. However, the precipitated coupler contains photographically active impurities which result in reduced yellow D-max when the coupler is re-used. In particular, as previously indicated hereinabove, reaction of the 1-phenyl-3-pyrazolidinone with the 4-amino-N-ethyl-N-(2-methoxyethyl)-m-toluidine di-p-toluene sulfonate yields a photographically active hydroxypyrazole. This compound, which has the structure

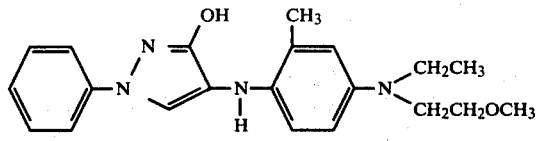

exhibits photographic effects which can be accounted for by two mechanisms. The major effect is probably as an active developing agent which competes with the 4-amino-N-ethyl-N-(2-methoxyethyl)-m-toluidine di-p-toluene sulfonate and with balancing developing agents present in the developing solution. A second effect is a coupling reaction, under oxidizing conditions, with the alpha-pivalyl-alpha-(4-carboxyphenoxy)-2,4-dichloroacetanilide to form a dye in the solution. This coupling reaction reduces the concentration of the alpha-pivalyl-alpha-(4-carboxyphenoxy)-2,4-dichloroacetanilide in the solution, and thereby results in a loss in yellow D-max.

To avoid the problems created by the hydroxypyrazole impurity, the recovery of the alpha-pivalyl-alpha-(4-carboxyphenoxy)-2,4-dichloroacetanilide can be carried out in a two-step precipitation procedure, using a first precipitation at a pH of 5.5 and a second precipitation at a pH of less than 2. The low pH second precipitation step is effective in removing the hydroxypyrazole. However, this requires the added cost and complexity of a second precipitation step in the recovery procedure.

When the 1-phenyl-3-pyrazolidinone is replaced by 4,4-dimethyl-1-phenyl-3-pyrazolidinone or other 4,4-disubstituted-1-aryl-3-pyrazolidinone, in accordance with this invention, the hydroxypyrazole is not formed, and the alpha-pivalyl-alpha-(4-carboxyphenoxy)-2,4-dichloroacetanilide is effectively recovered with the use of a single precipitation at a pH of 5.5.

The improved stability of the yellow-dye-forming developing compositions of this invention is illustrated by the following example.

A yellow-dye-forming developing solution was prepared containing 4.0 grams per liter of 4-amino-N-ethyl-N-(2-methoxyethyl)-m-toluidine di-p-toluene sulfonate, 4.0 grams per liter of alpha-pivalyl-alpha-(4-carboxyphenoxy)-2,4-dichloroacetanilide, and 0.46 grams per liter of 1-phenyl-3-pyrazolidinone. A second developing solution was prepared that was identical to the first, except that it contained 0.5 grams of 4-hydroxymethyl-4-methyl-1-phenyl-3-pyrazolidinone in place of the 0.46 grams of 1-phenyl-3-pyrazolidinone. A third developing solution was prepared that was identical to the first, except that it contained 0.5 grams of 4,4-dimethyl-1-phenyl-3-pyrazolidinone in place of the 0.46 grams of 1-phenyl-3-pyrazolidinone. Each of these developing solutions was stored for seven days under identical conditions at a temperature of 23° C. At the end of this time, the concentration of 4-amino-N-ethyl-N-(2-methoxyethyl)-m-toluidine di-p-toluene sulfonate was 2.6 grams per liter in the first developing solution, 2.9 grams per liter in the second developing solution, and 3.3 grams per liter in the third developing solution, while the concentration of alpha-pivalyl-alpha-(4-carboxyphenoxy)-2,4-dichloroacetanilide was 2.7 grams per liter in the first developing solution, 4.0 grams per liter in the second developing solution, and 4.0 grams per liter in the third developing solution. The first developing solution contained 0.36 grams per liter of the 1-phenyl-3-pyrazolidinone, while the second developing solution contained 0.47 grams per liter of the 4-hydroxymethyl-4-methyl-1-phenyl-3-pyrazolidinone and the third developing solution contained 0.49 grams per liter of the 4,4-dimethyl-1-phenyl-3-pyrazolidinone. These data indicate that the 4,4-disubstituted-1-aryl-3-pyrazolidinones provide significantly improved developer solution stability as compared to the 1-phenyl-3-pyrazolidinone, i.e., substantially less loss of developing agent and coupler.

The photosensitive layers present in the photographic elements processed in the developer compositions of this invention can contain any of the conventional silver halides as the photosensitive material, for example, silver chloride, silver bromide, silver bromoiodide, silver chlorobromide, silver chloroiodide, silver chlorobromoiodide, and mixtures thereof. These layers can contain conventional addenda and be coated on any of the photographic film supports, such as, for example, cellulose nitrate film, cellulose acetate film, polyvinyl acetal film, polycarbonate film, polystyrene film, polyethylene terephthalate film, and the like.

Processes employing the color developer compositions of this invention can vary widely in regard to such features as development time and development temperature. Thus, for example, the development time will typically be in the range from about 0.5 to about 20 minutes, and more usually in the range from about 1 to about 4 minutes, while the development temperature will typically be in the range from about 15° C. to about 55° C., and more usually in the range from about 25° C. to about 40° C.

The invention has been described in detail with particular reference to preferred embodiments thereof, but it will be understood that variations and modifications can be effected within the spirit and scope of the invention.

I claim:

1. A yellow-dye-forming photographic developing composition comprising (1) a haloacetanilide coupler of the formula

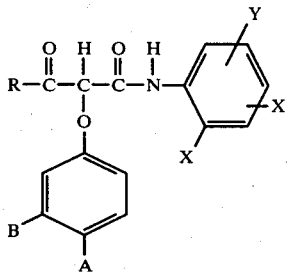

wherein R is a branched alkyl group of 3 to 6 carbon atoms, X is Cl or Br, Y is X, hydrogen or alkyl of 1 to 8 carbon atoms, and A and B differ and are either H or COOM where M is a photographically inactive cation or a methyl or ethyl group;

(2) an N-alkyl-N-alkoxyalkyl-p-phenylene-diamine develoing agent of the formula

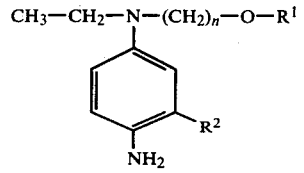

wherein n is an integer having a value of from 2 to 4, $R^1$ is alkyl of from 1 to 4 carbon atoms, and $R^2$ is alkyl of from 1 to 4 carbon atoms or alkoxy of from 1 to 4 carbon atoms;

and (3) a 4,4-disubstituted-1-aryl-3-pyrazolidinone balancing developing agent of the formula

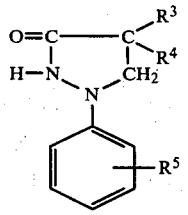

wherein $R^3$ and $R^4$ are the same or different and each is alkyl of 1 to 6 carbon atoms or hydroxyalkyl of 1 to 6 carbon atoms, and $R^5$ is hydrogen, halogen, alkyl of 1 to 6 carbon atoms, or alkoxy of 1 to 6 carbon atoms.

2. A yellow-dye-forming photographic developing composition comprising 4-amino-N-ethyl-N-(2-methoxyethyl)-m-toluidine di-p-toluene sulfonate, alpha-pivalyl-alpha-(4-carboxyphenoxy)-2,4-dichloroacetanilide, and 4,4-dimethyl-1-phenyl-3-pyrazolidinone.

3. A yellow-dye-forming photographic developing composition comprising 4-amino-N-ethyl-N-(2-methoxyethyl)-m-toluidine di-p-toluene sulfonate, alpha-pivalyl-alpha-(4-carboxyphenoxy)-2,4-dichloroacetanilide, and 4-hydroxymethyl-4-methyl-1-phenyl-3-pyrazolidinone.

4. An aqueous alkaline yellow-dye-forming photographic developing solution comprising from about 1 to about 4 grams per liter of a haloacetanilide coupler of the formula

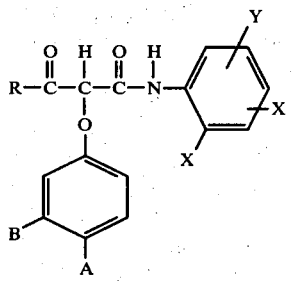

wherein R is a branched alkyl group of 3 to 6 carbon atoms, X is Cl or Br, Y is X, hydrogen or alkyl of 1 to 8 carbon atoms, and A and B differ and are either H or COOM where M is a photographically inactive cation or a methyl or ethyl group; from about 1 to about 4 grams per liter of an N-alkyl-N-alkoxyalkyl-p-phenylenediamine developing agent of the formula

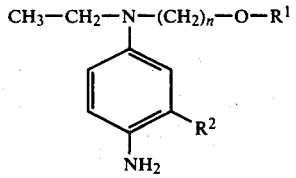

wherein n is an integer having a value of from 2 to 4, $R^1$ is alkyl of from 1 to 4, $R^1$ is alkyl of from 1 to 4 carbon atoms, and $R^2$ is alkyl of from 1 to 4 carbon atoms or alkoxy of from 1 to 4 carbon atoms; and from about 0.2 to about 0.8 grams per liter of a 4,4-disubstituted-1-aryl-3-pyrazolidinone balancing developing agent of the formula

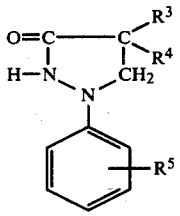

wherein $R^3$ and $R^4$ are the same or different and each is alkyl of 1 to 6 carbon atoms or hydroxyalkyl of 1 to 6 carbon atoms, and $R^5$ is hydrogen, halogen, alkyl of 1 to 6 carbon atoms, or alkoxy of 1 to 6 carbon atoms.

5. A developing solution as claimed in claim 4 wherein said haloacetanilide coupler is alpha-pivalyl-alpha-(4-carboxyphenoxy)-2,4-dichloroacetanilide, said N-alkyl-N-alkoxyalkyl-p-phenylenediamine developing agent is 4-amino-N-ethyl-N-(2-methoxyethyl)-m-toluidine di-p-toluene sulfonate, and said 4,4-disubstituted-1-aryl-3-pyrazolidinone balancing developing agent is 4,4-dimethyl-1-phenyl-3-pyrazolidinone or 4-hydroxymethyl-4-methyl-1-phenyl-3-pyrazolidinone.

6. In a method of reversal color processing of a photographic element in which said element is developed in a yellow-dye-forming photographic developing solution, the improvement wherein said solution comprises (1) a haloacetanilide coupler of the formula

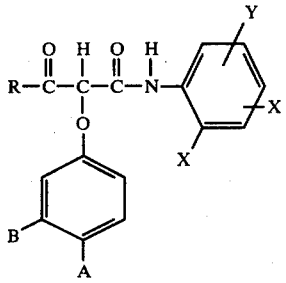

wherein R is a branched alkyl group of 3 to 6 carbon atoms, X is Cl or Br, Y is X, hydrogen or alkyl of 1 to 8 carbon atoms, and A and B differ and are either H or COOM where M is a photographically inactive cation or a methyl or ethyl group;

(2) an N-alkyl-N-alkoxyalkyl-p-phenylenediamine developing agent of the formula

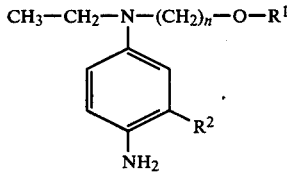

wherein n is an integer having a value of from 2 to 4, $R^1$ is alkyl of from 1 to 4 carbon atoms, and $R^2$ is alkyl of from 1 to 4 carbon atoms or alkoxy of from 1 to 4 carbon atoms;

and (3) a 4,4-disubstituted-1-aryl-3-pyrazolidinone balancing developing agent of the formula

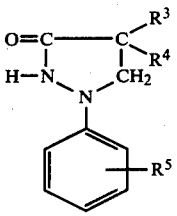

wherein $R^3$ and $R^4$ are the same or different and each is alkyl of 1 to 6 carbon atoms or hydroxyalkyl of 1 to 6 carbon atoms, and $R^5$ is hydrogen, halogen, alkyl of 1 to 6 carbon atoms, or alkoxy of 1 to 6 carbon atoms.

7. An improved method as claimed in claim 6 wherein said haloacetanilide coupler is alpha-pivalyl-alpha-(4-carboxyphenoxy)-2,4-dichloroacetanilide, said N-alkyl-N-alkoxyalkyl-p-phenylenediamine developing agent is 4-amino-N-ethyl-N-(2-methoxyethyl)-m-toluidine di-p-toluene sulfonate, and said 4,4-disubstituted-1-aryl-3-pyrazolidinone balancing developing agent is 4,4-dimethyl-1-phenyl-3-pyrazolidinone or 4-hydroxymethyl-4-methyl-1-phenyl-3-pyrazolidinone.

* * * * *